US006959675B2

(12) United States Patent
Nagano et al.

(10) Patent No.: US 6,959,675 B2
(45) Date of Patent: Nov. 1, 2005

(54) VALVE SYSTEM FOR INTERNAL COMBUSTION ENGINE

(75) Inventors: Shuji Nagano, Okazaki (JP); Toshihiko Oka, Anjyo (JP); Koichi Yoshimoto, Moriguchi (JP)

(73) Assignees: Mitsubishi Jidosha Kogyo Kabushiki Kaisha, Tokyo (JP); Mitsubishi Jidosha Engineering Kabushiki Kaisha, Kawasaki (JP)

( * ) Notice: Subject to any disclaimer, the term of this patent is extended or adjusted under 35 U.S.C. 154(b) by 0 days.

(21) Appl. No.: 10/735,901

(22) Filed: Dec. 16, 2003

(65) Prior Publication Data

US 2004/0123825 A1 Jul. 1, 2004

(30) Foreign Application Priority Data

Dec. 17, 2002 (JP) ..... 2002-364598

(51) Int. Cl.[7] ..... F01L 1/34

(52) U.S. Cl. ..... 123/90.16; 123/90.15; 123/90.12

(58) Field of Search ..... 123/90.12, 90.15–90.18; 91/365, 374, 378, 52, 469

(56) References Cited

U.S. PATENT DOCUMENTS 5,263,441 A * 11/1993 Rembold et al. ..... 123/90.12
5,421,359 A * 6/1995 Meister et al. ..... 137/12
5,619,965 A * 4/1997 Cosma et al. ..... 123/322
5,682,846 A * 11/1997 Scharnweber ..... 123/90.12
5,806,474 A * 9/1998 Paul et al. ..... 123/90.12
6,053,136 A * 4/2000 Albanello et al. ..... 123/90.16
6,085,705 A * 7/2000 Vorih ..... 123/90.12
6,112,710 A * 9/2000 Egan et al. ..... 123/90.12
6,167,853 B1 * 1/2001 Letsche ..... 123/90.12
6,244,257 B1 * 6/2001 Hu ..... 123/568.14
6,321,701 B1 * 11/2001 Vorih et al. ..... 123/90.12
6,321,703 B1 * 11/2001 Diehl et al. ..... 123/90.12
6,325,028 B1 * 12/2001 Albanello et al. ..... 123/90.12
6,530,350 B2 * 3/2003 Chiappini et al. ..... 123/90.12

FOREIGN PATENT DOCUMENTS

JP 5-240012 A 9/1993
JP 10-54215 A 2/1998
JP 11-13429 A 1/1999
JP 2001-41017 A 2/2001

* cited by examiner

*Primary Examiner*—Thomas Denion
*Assistant Examiner*—Jaime Corrigan
(74) *Attorney, Agent, or Firm*—Birch, Stewart, Kolasch & Birch, LLP

(57) ABSTRACT

A valve system for an internal combustion engine in which accumulating means can be provided without deteriorating the ease of assembly is provided. A variable valve control mechanism provides control to selectively open and close intake valves and exhaust valves. Pressurized oil supplied to the variable valve control mechanism is accumulated in an accumulator. The body of the accumulator is inserted into and fixed in a hole of a cylinder head. The length of a gap formed between the upper part of the body of the accumulator and a flat plate is set to be shorter than the length of a screw part of the body of the accumulator. Therefore, the accumulator can be replaced and maintained easily, and can be prevented from falling off.

9 Claims, 11 Drawing Sheets

VALVE SYSTEM FOR INTERNAL COMBUSTION ENGINE

CROSS-REFERENCE TO RELATED APPLICATION

This nonprovisional application claims priority under 35 U.S.C. §119(a) on Patent Application No. P2002-364598 filed in Japan on Dec. 17, 2002, the entire contents of which are hereby incorporated by reference.

BACKGROUND OF THE INVENTION

1. Field of the Invention

The present invention relates to a valve system for an internal combustion engine, which is capable of driving intake valves and exhaust valves of the internal combustion engine to open and close at different timings.

2. Description of Related Art

In recent years, a valve system, which is capable of optimizing operating characteristics (e.g., opening/closing timing, an opening time period, and so forth) of intake valves and exhaust valves (engine valves) of a reciprocating internal combustion engine according to engine load and engine speed, has been developed and put into practical use.

To optimize the operating characteristics in this valve system, a mechanism has been developed which is capable of opening and closing the engine valves by selectively using a low-speed cam with a cam profile suitable for low-speed engine revolution or a high-speed cam with a cam profile suitable for high-speed engine revolution according to the revolutionary state of the engine. For example, there is known a mechanism which selectively uses a low-speed cam or a high-speed cam by using means for selectively supplying or releasing oil pressure. Further, a variety of techniques have been developed in which accumulating means is provided in a channel via which pressurized oil is supplied and released.

In Japanese Laid-Open Patent Publication (Kokai) No. 11-13429 and Japanese Laid-Open Patent Publication (Kokai) No. 10-54215, conventional valve systems are disclosed in which an accumulating means is provided. Conventionally, the accumulating means has been provided as a hydraulic control system and formed integrally with a variable valve control mechanism as disclosed in Japanese Laid-Open Patent Publication (Kokai) No. 5-240012. The hydraulic control system is fastened within a cylinder head via bolts. However, if the accumulating means is disposed as disclosed in the third Patent publication, the accumulating means is connected to the cylinder head via another member. Therefore, the hydraulic control system is large in size, and the internal arrangement (layout) of the cylinder head is complicated. Also, a channel for pressurized oil needs to have an extra length so that the accumulating means can be connected to the cylinder head via another member. Further, oil leakage or the like occurring on a surface of abutment between another member and a mounting part of the cylinder head must be taken into consideration. As a result, the manufacturing cost is increased. On the other hand, in the case where the accumulating means is provided in a cylinder block, if an accumulating chamber is formed in the cylinder block and the accumulating means is formed integrally with the cylinder head, the accumulating chamber is integrated with the cylinder block, so that the manufacturing cost and the machining cost can be suppressed. However, the accumulating means is configured as part of an internal combustion engine, and hence the replacement and maintenance of the accumulating means are difficult.

SUMMARY OF THE INVENTION

It is therefore an object of the present invention to provide a valve system for an internal combustion engine, which is provided with accumulating means without deteriorating the ease of assembly.

To attain the above object, there is provided a valve system for an internal combustion engine, which comprises: variable valve control means for providing control to selectively open and close intake valves or exhaust valves according to supply/release of pressurized oil from an oil pressure source via an oil channel; and accumulating means provided upstream of the variable valve control means and inserted into and fixed in a hole formed in a cylinder head of the internal combustion engine, for accumulating pressurized oil supplied to the variable valve control means.

It is preferred that the accumulating means is comprised of a cylindrical body fixed which is vertically fixed to the cylinder head; a piston capable of sliding in contact with an inner peripheral surface of the body; and a spring that forces the piston downward, wherein the accumulating means is operable when accumulating pressurized oil, for pushing up the piston against the force of the spring by pressurized oil, and is operable when releasing pressurized oil, pushing down the piston by the force of the spring, and wherein an upper part of the body is disposed in the vicinity of an inner wall of a head cover for the cylinder head.

Further, it is preferred that the length of a gap formed between the upper part of the body and the inner wall of the head cover is shorter than the length of part of the body which is vertically fixed to the cylinder head.

Further, it is preferred that the part of the body which is fixed to the cylinder head is comprised of a screw part.

According to the foregoing present invention, the accumulating means is fixed as a single body to the cylinder head, and hence the accumulating means can be e.g., replaced and maintained easily.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

An embodiment of a valve system for an internal combustion engine according to the present invention will now be described with reference to the accompanying drawings.

Figure 1:
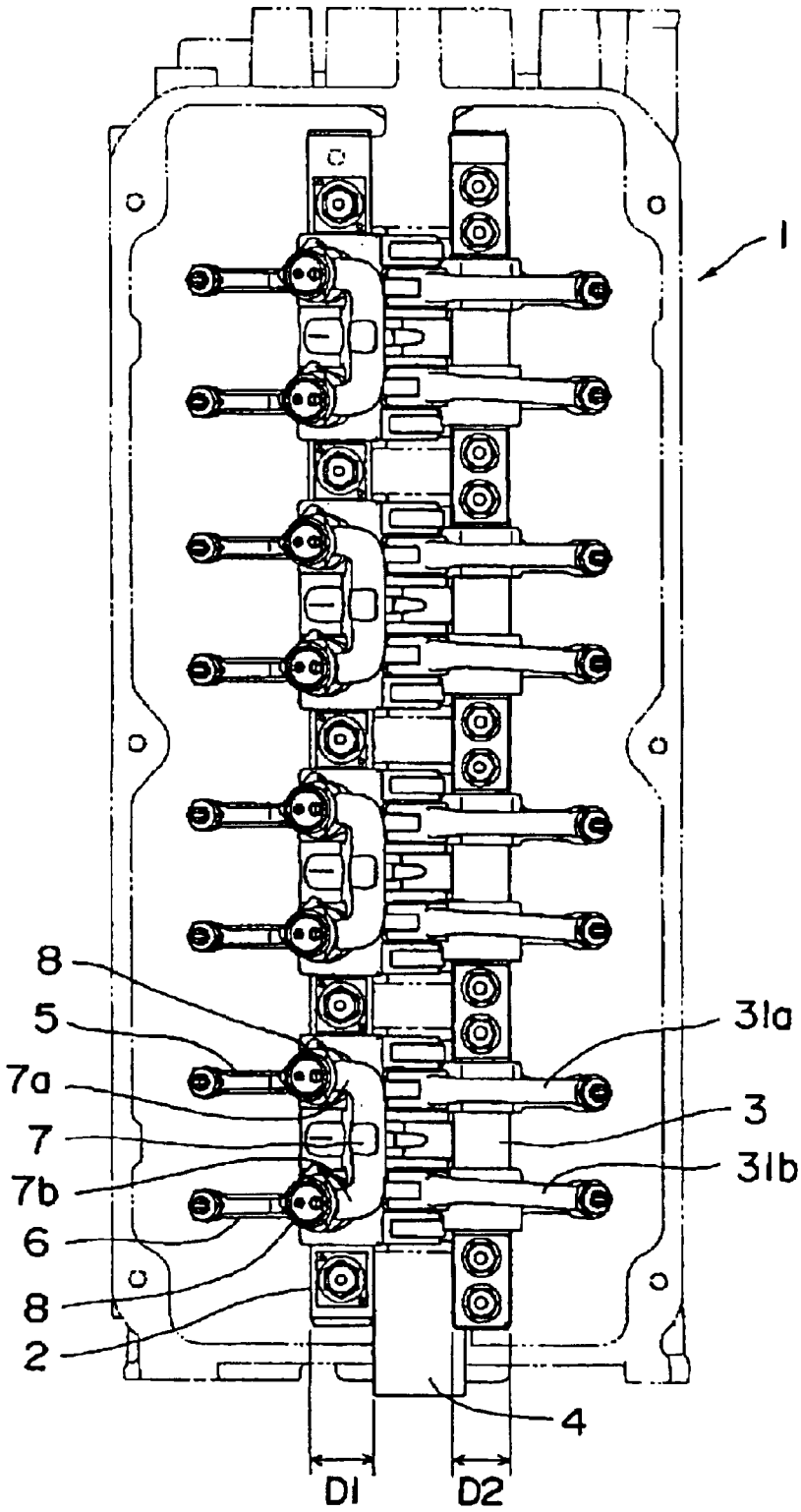
FIG. 1 is a plan view showing a head of an internal combustion engine equipped with a valve system according to an embodiment of the present invention.

As shown in FIG. 1, a rocker shaft 2 on an intake side and a rocker shaft 3 on an exhaust side are arranged parallel to each other and fixed to a cylinder head 1. A cam shaft 4 is rotatably supported on part of the cylinder head 1 between the rocker shaft 2 and the rocker shaft 3. In the illustrated example, an internal combustion engine is comprised of four cylinders arranged in series, for each of which two intake valves and two exhaust valves are provided.

As shown in FIGS. 1 to 5, for each cylinder, a first rocker arm 5 and a third rocker arm 6 are supported on the rocker shaft 2 such that the arms 5 and 6 may rock. A T-shaped second rocker arm 7 is supported on part of the rocker shaft 2 between the first rocker arm 5 and the third rocker arm 6 such that the arm 7 may rock. Cylinder parts 8, serving as a connection switching mechanism, are formed on respective ones of the first rocker arm 5 and the third rocker arm 6, and T-shaped ends 7*a*, 7*b* of the second rocker arm 7 are connectable to the cylinder parts 8.

The first rocker arm 5 has an end thereof connected to a first intake valve 9 and a base end thereof adapted to be driven by a first low-lift cam 10. The third rocker arm 6 has an end thereof connected to a second intake valve 11 and a base end thereof adapted to be driven by a second low-lift cam 12 which causes a lower valve lift than the first low-lift cam 10. Namely, the first intake valve 9 and the second intake valve 11 are opened and closed at predetermining timings and with different valve lifts. It should be noted that the second low-lift cam 12 may be designed to have such a shape as to substantially suspend the intake valve 11.

As shown in FIGS. 3, 4, 7, and 8, the cylinder parts 8 are formed on the respective ones of the first rocker arm 5 and the third rocker arm 6. The cylinder parts 8 are formed with respective openings 13*a*, 13*b* opposed to the T-shaped ends 7*a*, 7*b* of the second rocker arm 7. Pistons 14*a*, 14*b* are provided in the respective cylinder parts 8 so that the pistons 14*a*, 14*b* can slide in contact with the cylinder parts 8. The pistons 14*a*, 14*b* are provided with cylindrical parts 15*a*, 15*b* which slide in contact with inner walls of the cylinder parts 8, and are formed with notches 16*a*, 16*b* notched in the vicinity of the openings 13*a*, 13*b* and continuously from the upper parts of the cylindrical parts 15*a*, 15*b*.

Figure 3:
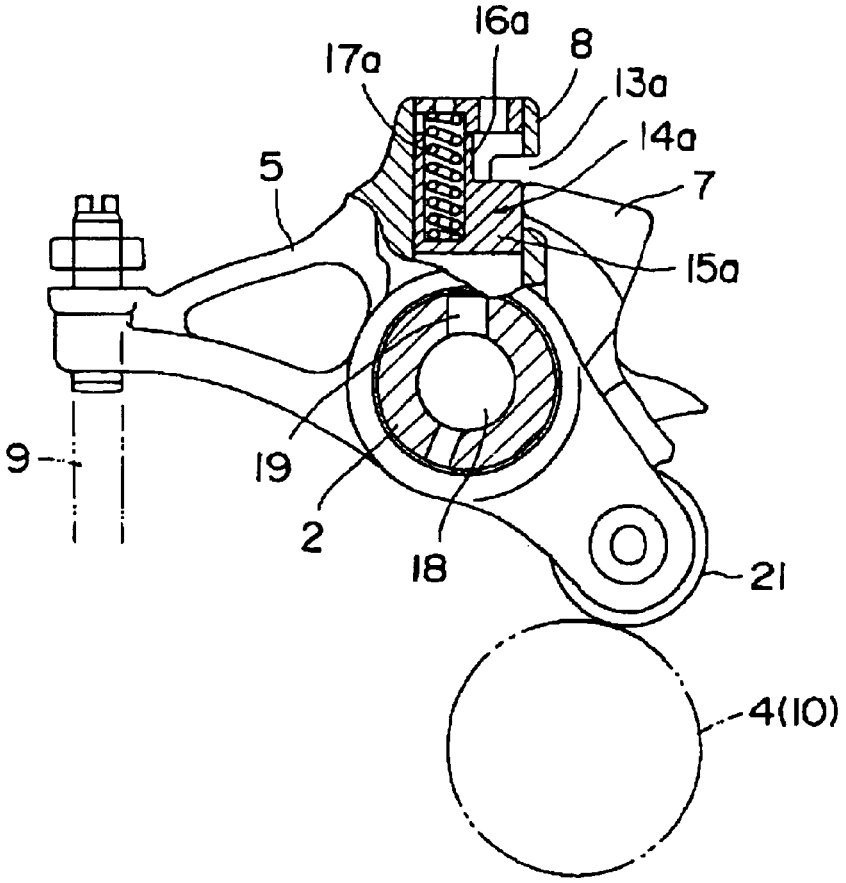
FIG. 3 is a view taken in the direction of an arrow along line III—III of FIG. 2.
Figure 4:
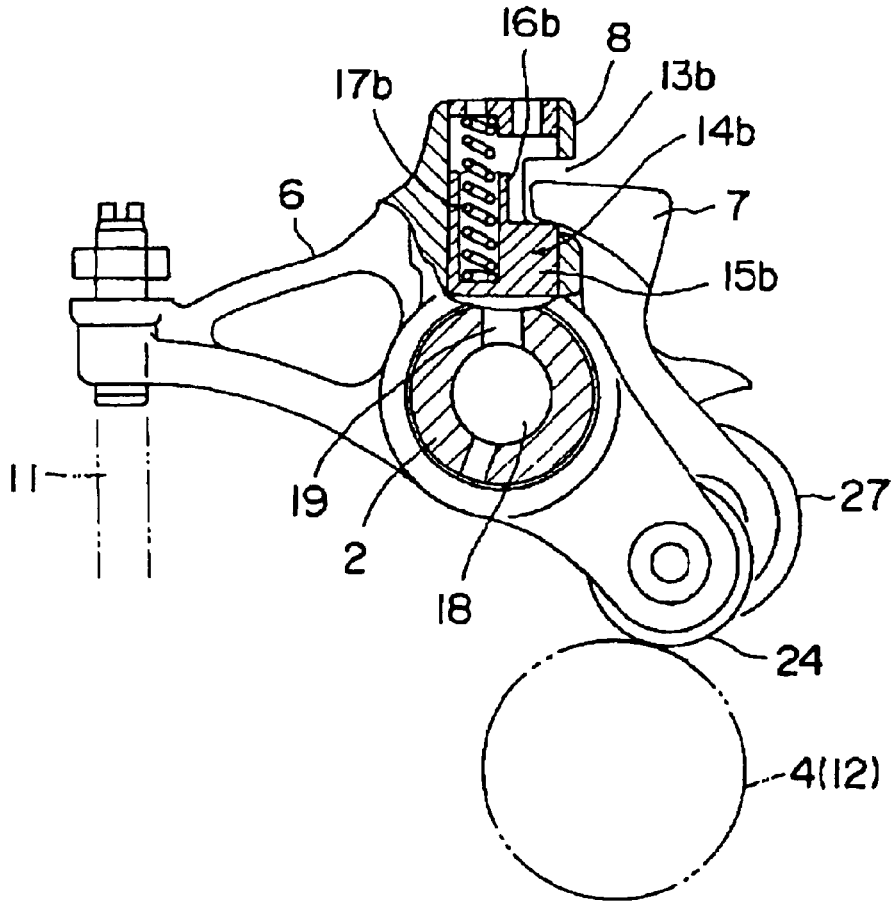
FIG. 4 is a view taken in the direction of an arrow along line IV—IV of FIG. 2.

Further, the pistons 14*a*, 14*b* are forced downward by return springs 17*a*, 17*b*, and normally the notches 16*a*, 16*b* face the openings 13*a*, 13*b* as shown in FIG. 4. An oil channel 18 is formed on an axis of the rocker shaft 2, and is supplied with pressurized oil in predetermined timing by a pressurized oil-supplying mechanism, described later. The pressurized oil is supplied to the oil channel 18 through a channel 19, causing the pistons 14*a*, 14*b* to move upward against forces of the return springs 17*a*, 17*b*. The upward movement of the pistons 14*a*, 14*b* resulting from the supply of the pressurized oil causes the cylindrical parts 15*a*, 15*b* to face the openings 13*a*, 13*b* as shown in FIG. 3.

As shown in FIGS. 1 to 5, the second rocker arm 7 has the T-shaped ends 7*a*, 7*b* thereof connected to insides of the openings 13*a*, 13*b*, and a base end thereof adapted to be driven by a high-lift cam 20. The high-lift cam 20 causes a higher valve lift as compared to the first low-lift cam 10 and the second low-lift cam 12, and has a cam profile encompassing the cam profile of the first low-lift cam 10 and the second low-lift cam 12.

In the state in which the pistons 14*a*, 14*b* are forced downward by the return springs 17*a*, 17*b* and the notches 16*a*, 16*b* face the openings 13*a*, 13*b* (i.e., no pressurized oil is supplied), when the second rocker arm 7 is driven by the high-lift cam 20, the T-shaped ends 7*a*, 7*b* of the second rocker arm 7 are caused to face the notches 16*a*, 16*b* within the openings 13*a*, 13*b*. Therefore, in the case where the high-lift cam 20 drives the second rocker arm 7 to rock, the ends 7*a*, 7*b* of the second rocker arm 7 enter the notches 16*a*, 16*b* (i.e., a disconnected state), and the rocking force of the second rocker arm 7 is transmitted to neither the first rocker arm 5 nor the third rocker arm 6.

Therefore, by releasing the pressurized oil from the cylinder parts 8, the rocking forces of the first rocker arm 5 and the third rocker arm 6 causes the first intake valve 9 and the second intake valve 11 to open and close at a predetermined timing and with different valve lifts, i.e. valve lifts suitable for respective shapes of the first low-lift cam 10 and the second low-lift cam 12.

When the pressurized oil is supplied to the cylinder parts 8 to cause the pistons 14*a*, 14*b* to move upward against forces of the return springs 17*a*, 17*b* and to cause the cylindrical parts 15*a*, 15*b* to face the openings 13*a*, 13*b*, the T-shaped ends 7*a*, 7*b* of the second rocker arm 7 are opposed to the cylindrical parts 15*a*, 15*b* within the openings 13*a*, 13*b*. Therefore, in the case where the high-lift cam 20 drives the second rocker arm 7 to rock, the T-shaped ends 7*a*, 7*b* of the second rocker arm 7 abut the cylindrical parts 15*a*, 15*b* (i.e., a connected state), and the rocking force of the second rocker arm 7 is transmitted to the first rocker arm 5 and the third rocker arm 6 via the cylinder parts 8.

Therefore, the supply of pressurized oil to the cylinder parts 8 opens and closes the first intake valves 9 and the second intake valve 11 with a large valve lift corresponding to the cam profile of the high-lift cam 20 due to the rocking of the first rocker arm 5 and the third rocker arm 6 caused by the rocking of the second rocker arm 7.

Whether pressurized oil is to be supplied to or released from the cylinder parts 8, i.e., whether the second rocker arm 7 is to be connected to or disconnected from the first rocker arm 5 and the third rocker arm 6 is set in advance according to vehicle driving conditions (the revolutionary speed of the internal combustion engine).

For example, when the internal combustion engine is revolving at a low speed, oil pressure is released from the cylinder parts 8 to rock the first rocker arm 5 and the third rocker arm 6, thus opening and closing the first intake valve 9 and the second intake valve 11 in respective predetermined timing and with different valve lifts. This promotes swirling to intensify combustion. On the other hand, when the internal combustion engine is revolving at a high speed, oil pressure is supplied to the cylinder parts 8 to rock the second rocker arm 7, thus rocking the first rocker arm 5 and the third rocker arm 6, thus opening and closing the first intake valve 9 and the second intake valve 11 at the same time and with large lift valves. This ensures a large amount of intake air to increase engine power.

Figure 7:
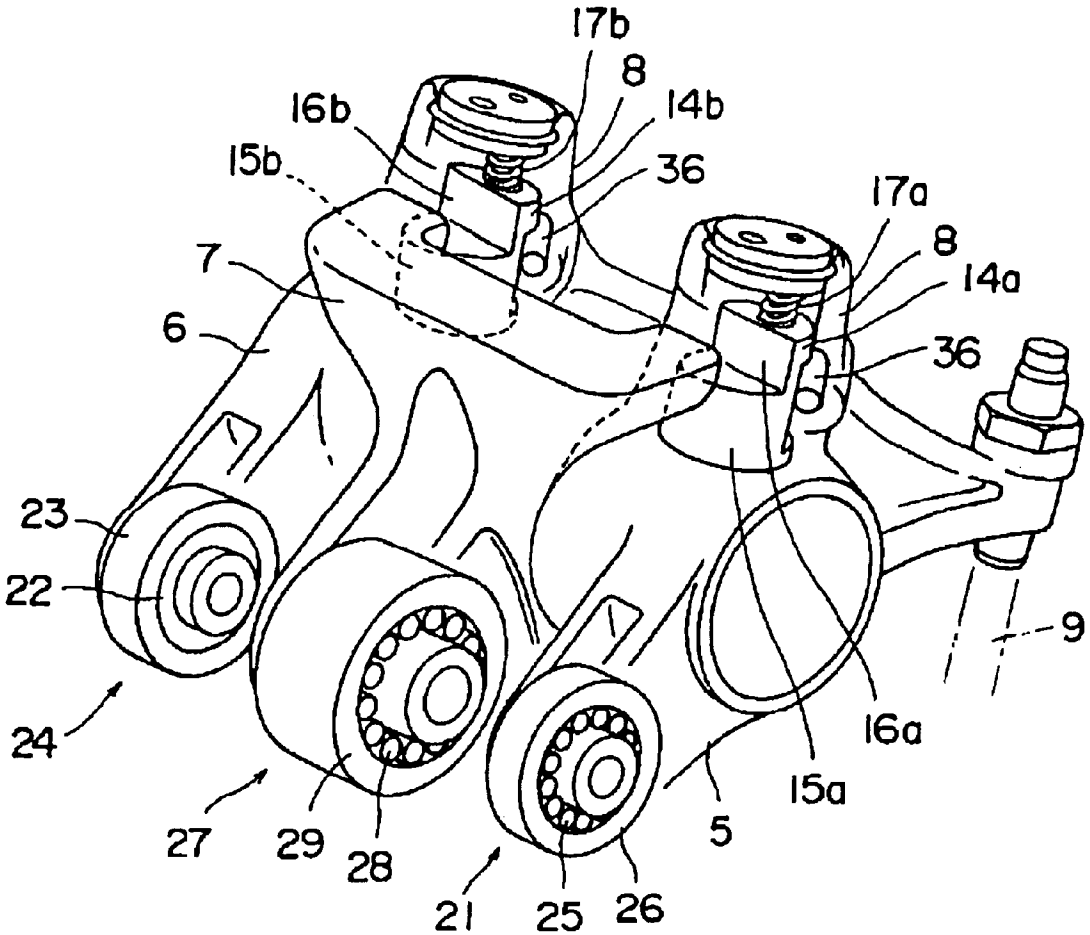
FIG. 7 is a perspective view showing a rocker arm as viewed from a cam shaft.

As shown in FIGS. 3 and 7, a first roller follower 21 is provided in part of the base end of the first rocker arm 5, which is abutted on the first low-lift cam 10. Thus, the base end of the first rocker arm 5 is abutted with the minimum resistance on the rotating first low-lift cam 10 via the first roller follower 21. As shown in FIG. 7, the first roller follower (needle bearing) 21 is comprised of an external roller 26, which is capable of rotating via a large number of needle rollers 25, and is in rolling contact with the first low-lift cam 10.

As shown in FIGS. 4 and 7, a third roller follower 24 is provided in part of the base end of the third rocker arm 6, which is abutted on the second low-lift cam 12. Thus, the base end of the third rocker arm 6 is abutted with no resistance on the rotating second low-lift cam 12 via the third roller follower 24. As shown in FIG. 7, the third roller follower 24 is comprised of an internal roller 22 and an external roller 23 (double-ring type sliding rollers), which are rotatably engaged with each other and concentric with each other. The external roller 23 is in rolling contact with the second low-lift cam 12. The surface of the internal roller 22 is e.g., surface-treated so that it can be smooth.

Figure 5:
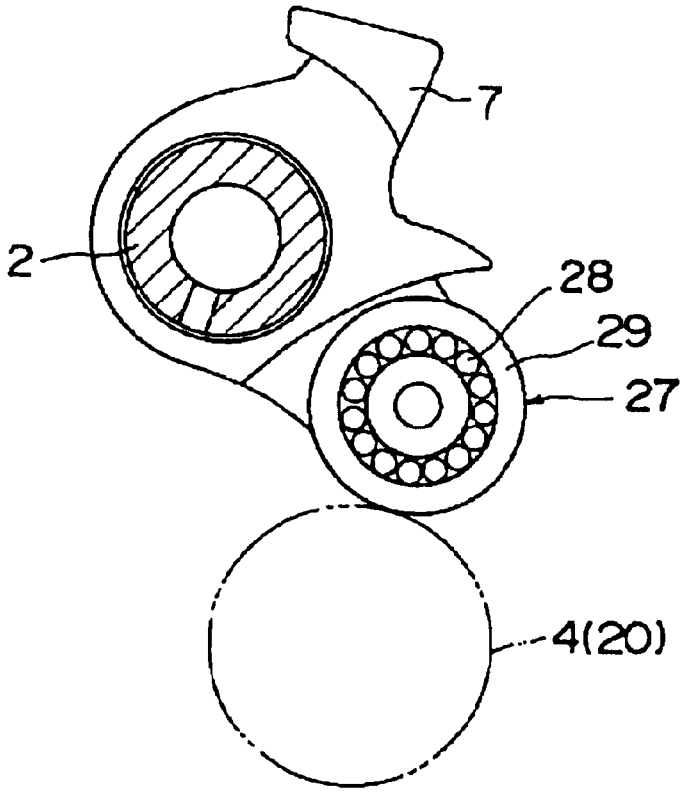
FIG. 5 is a view taken in the direction of an arrow along line V—V of FIG. 2.

As shown in FIGS. 5 and 7, a second roller follower 27 is provided in part of the base end of the second rocker arm 7, which is abutted on the high-lift cam 20. Thus, the base end of the second rocker arm 7 is abutted with no resistance on the rotating high-lift cam 20 via the second roller follower 27. The second roller follower 27 (needle bearing) is comprised of an external roller 29, which is capable of rotating via a large number of needle rollers 28, and is in rolling contact with the high-lift cam 20.

It should be noted that as is the case with the third roller follower 24, the first roller follower 21 may be comprised of the internal roller 22 and the external roller 23 (double-ring type sliding rollers), which is in rolling contact with the first low-lift cam 10.

Further, as shown in FIG. 1, exhaust rocker arms 31*a*, 31*b* are supported on the exhaust side rocker shaft 3 such that the arms 31*a*, 31*b* may rock, and each of the exhaust rocker arms 31*a*, 31*b* is adapted to be driven by an exhaust cam.

By the way, for example, it is configured such that the high-lift cam 20 lifts the first intake valve 9 and the second intake valve 11 by a large amount, the first low-lift cam 10 lifts the first intake valve 9 by a slightly smaller amount as compared with the high-lift cam 20, and the second low-lift cam 12 lifts the second intake valve 11 by a much smaller amount as compared with the high-lift cam 20.

For this reason, when pressurized oil is supplied to the cylinder parts 8 (i.e., the connected state) to rock the second rocker arm 7, thus rocking the first rocker arm 5 and the third rocker arm 6 to open and close the first intake valve 9 and the second intake valve 11 at the same time and with a large valve lift, the high-lift cam 20 lifts the first intake valve 11 and the second intake valve 11 by a larger amount as compared with the second low-lift cam 12 and the first low-lift cam 10. Therefore, the internal combustion engine is operated in the state in which a large gap is formed between the second low-lift cam 12 and the third roller follower 24, and a gap is formed between the first low-lift cam 10 and the first roller follower 21.

Although not described, the second rocker arm 7 is constantly urged toward the cams. In the state in which pressurized oil is supplied to the cylinder parts 8 to rock the second rocker arm 7, thus rocking the first rocker arm 5 and the third rocker arm 6 to open and close the first intake valve 9 and the second intake valve 11, when the pressurized oil is released from the cylinder parts 8, i.e., the state of intake is switched, the rocking force of the second rocker arm 7 is inhibited from being transmitted, so that the first rocker arm 5 and the second rocker arm 6 are forced to rock toward the first low-lift cam 10 and the second low-lift cam 12.

In this case, since a large gap is formed between the second low-lift cam 12 and the third roller follower 24 at the maximum valve lift, when the first rocker arm 5 and the third rocker arm 6 are forced to rock toward the first low-lift cam 10 and the second low-lift cam 12, the third roller follower 24 and the first roller follower 21 may be struck against the second low-lift cam 12 and the first low-lift cam 10.

Only a slight gap is formed between the first roller follower 21 and the first low-lift cam 10, and hence a great force never acts when the first roller follower 21 is struck against the first low-lift cam 10, whereas a large gap is formed between the third roller follower 24 and the second low-lift cam 12, and hence a great force acts when the third roller follower 24 is struck against the second low-lift cam 12.

Therefore, the third roller follower 24 has a double-ring type sliding roller structure comprised of the internal roller 22 and the external roller 23. This improves the impact strength of the third roller follower 24; if the third roller follower 24 is struck against the second low-lift cam 12 with a great force, the force is transmitted with pressure being applied to a surface, so that the third external roller 23 can be prevented from being damaged due to deformation or impression.

Thus, part of the third rocker arm 6, which is abutted on the rotating second low-lift cam 12, is constructed in consideration of stiffness and rotational resistance.

Although in the above described embodiment, in the internal combustion engine in which two different types of rocker arms i.e., the first rocker arm 5 and the third rocker arm 6 which cause smaller valve lifts as compared with the second rocker arm 7 which causes a large valve lift, the third roller follower 24 for the second low-lift cam 12 which causes a much smaller valve lift than the second rocker arm 7 has the sliding roller structure, the present invention is not limited to this, but the first roller follower 21 may be configured to have the sliding roller structure.

Further, the present invention in which a roller which abuts a cam which causes a smaller valve lift is constructed as the first roller follower having the sliding roller structure may be applied to an internal combustion engine of a one intake valve type which is capable of switching between two rocker arms which cause different valve lift lifts as disclosed in Japanese Laid-Open Patent Publication No. 2001-41017 filed by the applicant of the present invention.

Figure 8:
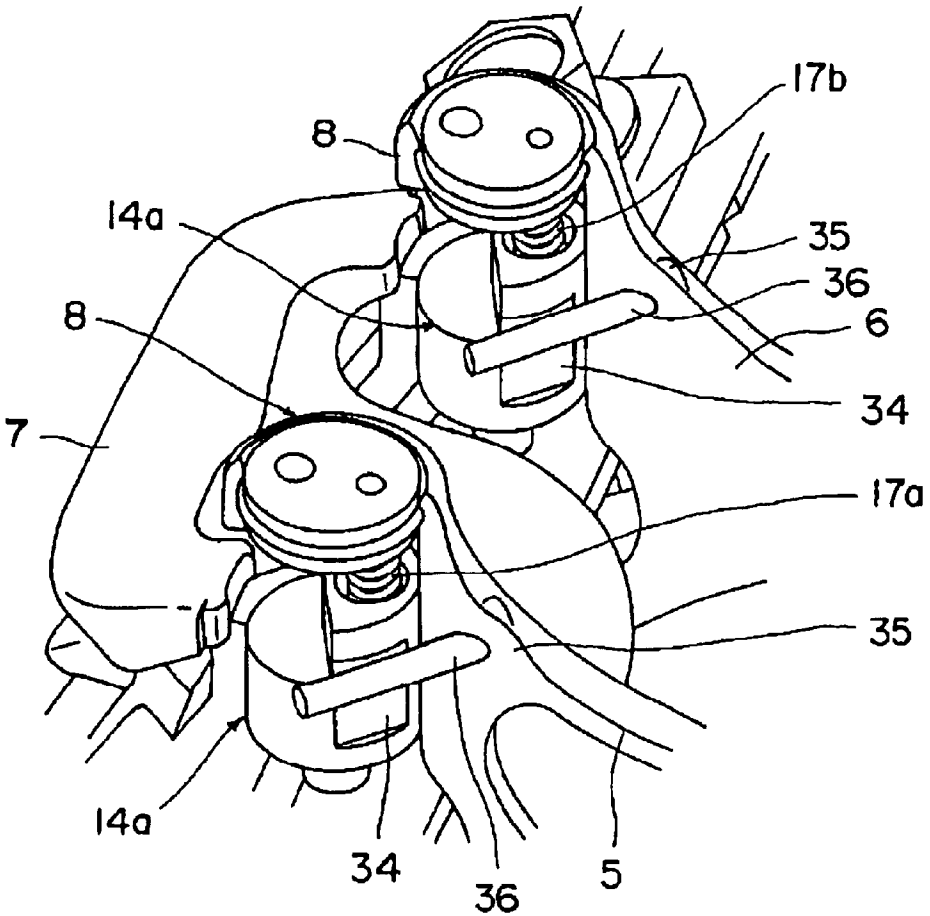
FIG. 8 is a perspective view showing a rocker arm as viewed from an intake valve.

As shown in FIG. 8, since the notches 16 are formed at the upper part of the pistons 14, the return springs 17 are arranged at locations deviated from the axes of the pistons 14. Thus, when the pistons 14 rotate about the axes thereof, the return springs 17 cannot apply force as designed. Therefore, in the illustrated embodiment, as shown in FIGS. 6 and 7, mechanisms for stopping the rotation of the pistons 14 are provided.

Figure 2:
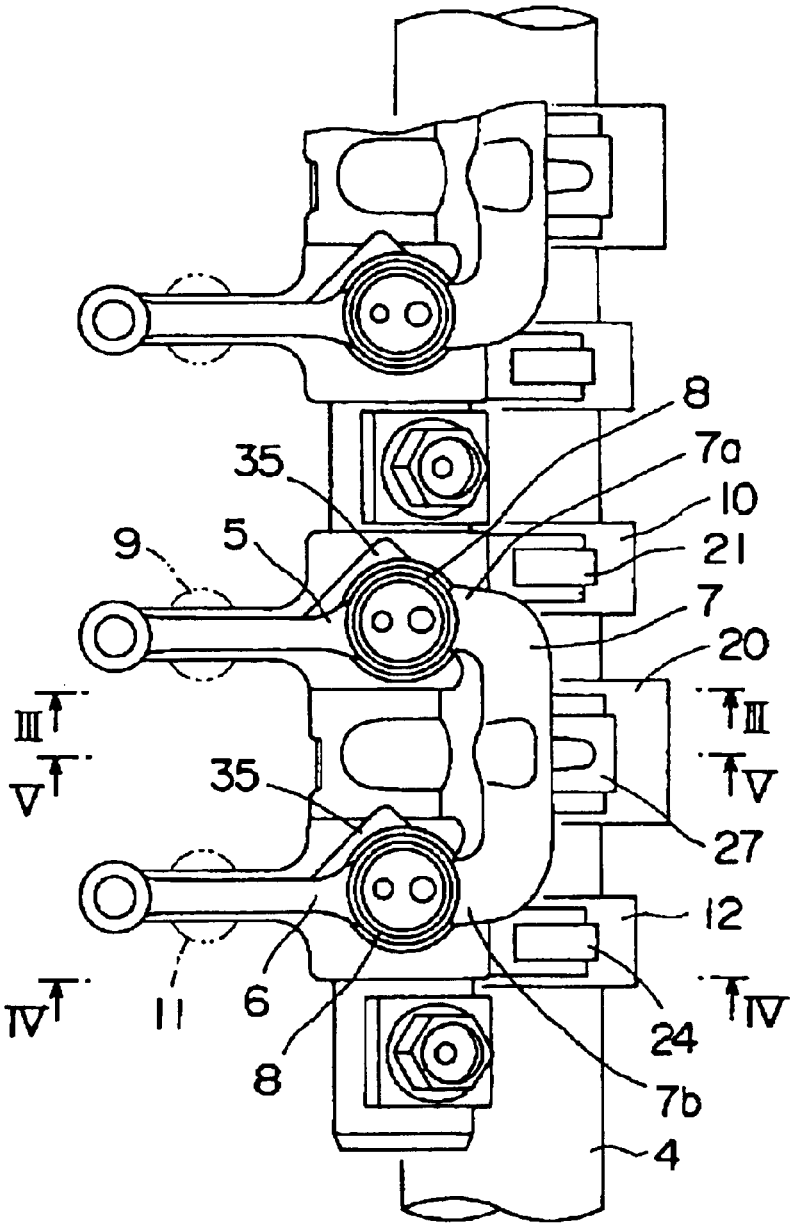
FIG. 2 is an enlarged view showing essential parts in FIG. 1.
Figure 6:
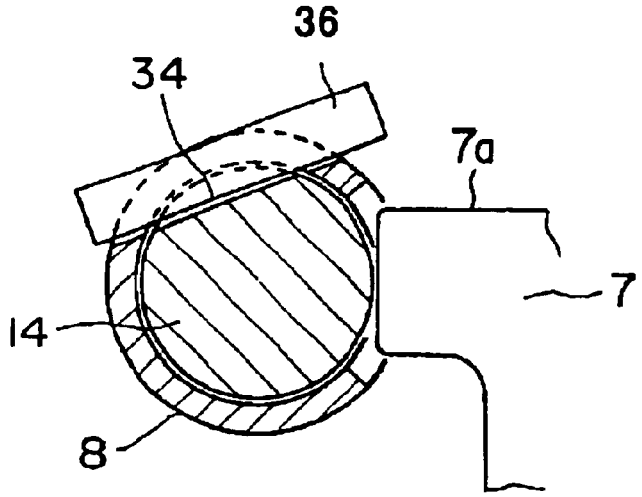
FIG. 6 is a sectional view showing a piston supporting part.

As shown in FIGS. 2, 6, and 8, notch surfaces 34 are formed on the circumference of part of the pistons 14 where the notches 16 are formed, and bosses 35 (refer to FIG. 2) corresponding to the notch surfaces 34 are formed in the cylinder parts 8 of the first rocker arm 5 and the third rocker arm 6. The notch surfaces 34 are formed at locations away from the openings 13 in the cylinder parts 8 and away from the back surfaces of the pistons 14, and are arranged such that pins 36 are diagonally fitted on the notch surfaces 34 in an axial direction. The pins 36 are fixed in the bosses 35 by press-fitting or the like, and are arranged with its axes extending on a plane parallel with a horizontal plane along the rocker shaft 2.

To stop the rotation of the pistons 14, the pins 36 may be arranged in a direction perpendicular to the horizontal plane along the rocker shaft 2, but in this case, the cylindrical parts 15 at the lower parts of the pistons 14 must be formed with parts into which the pins 36 can be fitted. The cylindrical parts 15 are intended to prevent oil leakage by moving in sliding contact with the cylinder parts 8, but if the cylindrical parts 8 are formed with parts into which the pins 36 can be fitted, oil may be leaked. Therefore, the pins 36 are arranged with the axes thereof extending on the plane parallel with the horizontal plane along the rocker shaft 2.

The back surfaces of the pistons 14 have the maximum load applied thereto from the second rocker arm 7 in the case where the first rocker arm 5 and the third rocker arm 6 are caused to rock by rocking of the second rocker arm 7. For this reason, the pins 36 are diagonally arranged at locations away from the back surfaces of the pistons 14. Further, the pins 36 are fixed on the bosses 35 and arranged at locations away from the openings 13 in the cylinder parts 8. Therefore, the ends 7*a,* 7*b* of the second rocker arm 7 are never inhibited from moving from the openings 13 toward the pistons 14, and also, the rocking force of the second rocker arm 7 can be transmitted over the entire back surfaces of the pistons 14.

The notch surfaces 15 are formed to reach middle parts of the cylindrical parts 15, and the pins 36 prevent the pistons 14 from falling off. As shown in FIGS. 2 and 8, in the cylinder parts 8 of the first rocker arms 5 and the third rocker arm 6, the bosses 35 are formed in the same direction, the notch surfaces 34 of the pistons 14 are formed in the same direction, and the pins 36 are arranged parallel with each other. Therefore, the pistons 14 of the first rocker arm 5 and the third rocker arm 6 can be shared to reduce costs required for parts and prevent erroneous assembly.

By the way, for each cylinder, the first rocker arm 5, third rocker arm 6, and second rocker arm 7 are supported on the intake side rocker shaft 2, and the first rocker arm 5 and the third rocker arm 6 are provided with respective switching mechanisms including the cylinder parts 8 and the pistons 14. For this reason, a valve switching mechanism on the intake side is more complicated and heavier than a valve switching mechanism on the exhaust side.

Therefore, according to the present invention, as shown in FIG. 1, the diameter D1 of the intake side rocker shaft 2 is set to be (e.g., about 10%) larger than the diameter D2 of the exhaust side rocker shaft 3. This secures such stiffness as to compensate for excess in weight, and improves operating characteristics of the valve system. Further, since the diameter D1 of the rocker shaft 2 is set to be larger than the diameter D2 of the rocker shaft 3, the inner diameter of the oil channel 18 can also be increased, making it possible to reduce pressure loss in pressurized oil flowing through the oil channel 18 and to improve the performance of the switching mechanisms.

Figure 9:
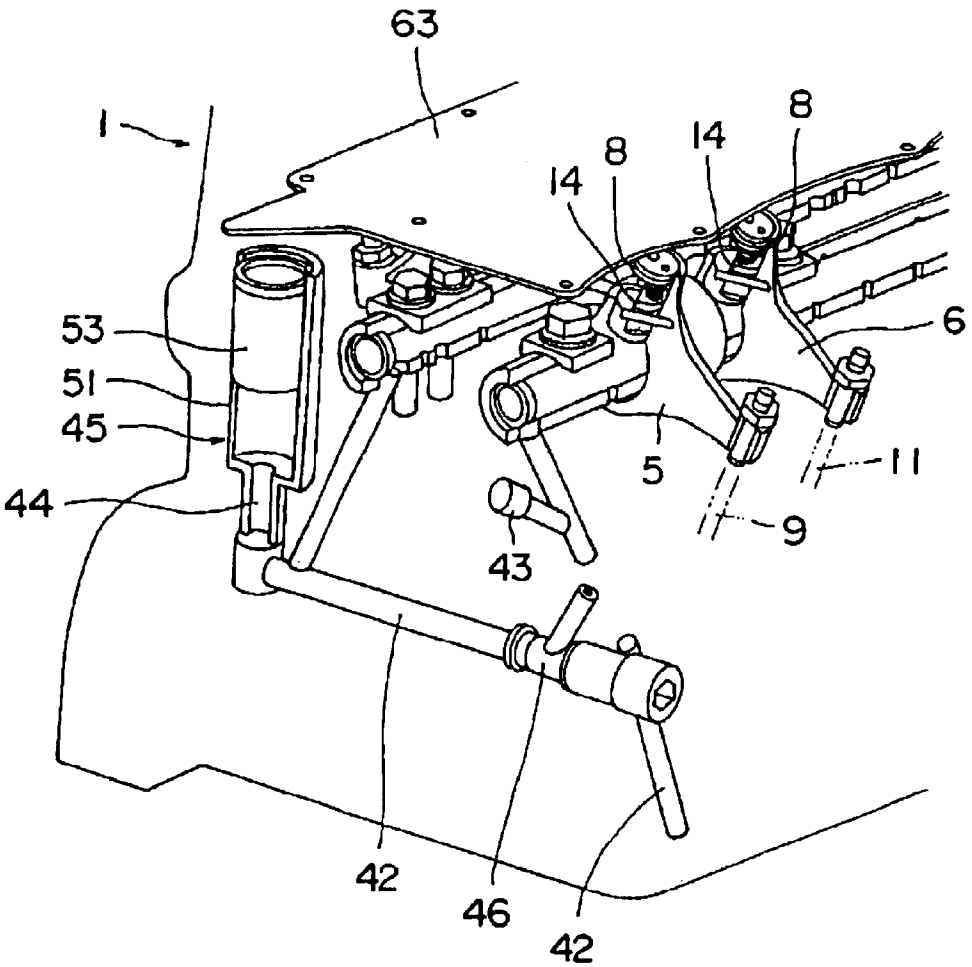
FIG. 9 is a perspective view showing essential parts i.e., a hydraulic system of the internal combustion engine.
Figure 10:
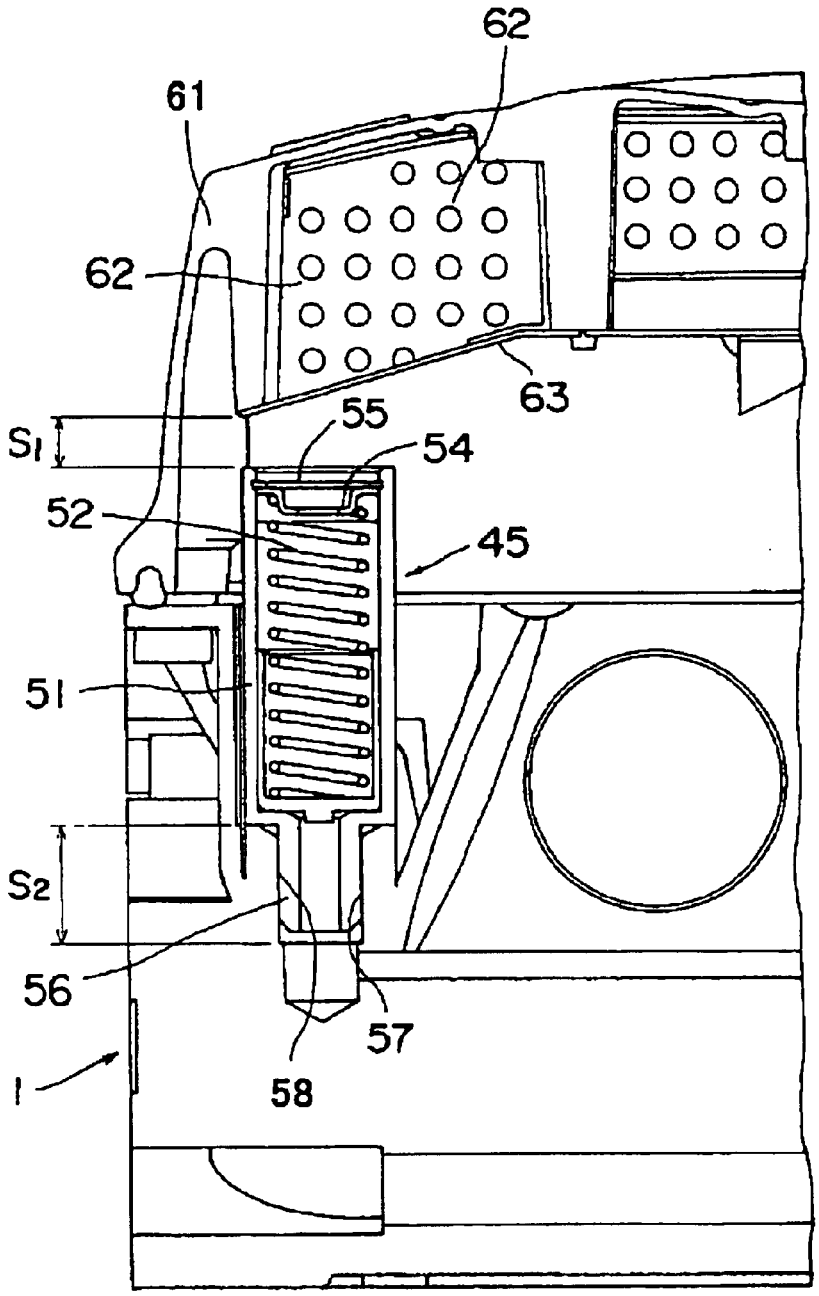
FIG. 10 is a sectional view showing the state in which an accumulator is mounted.
Figure 11:
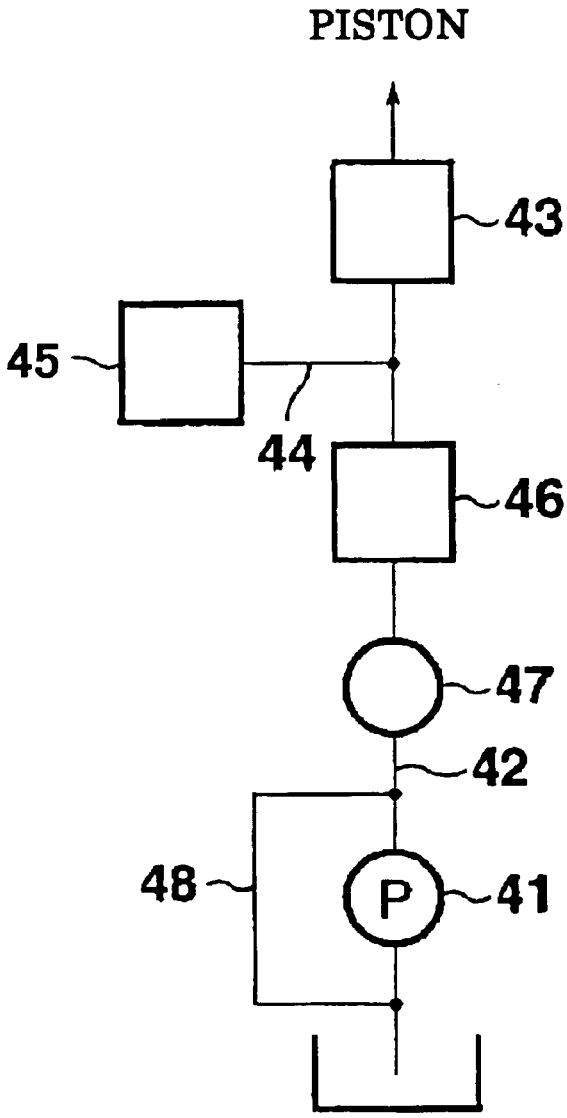
FIG. 11 is a circuit diagram schematically showing the hydraulic system.

Referring next to FIGS. 9 to 11, a description will be given of a mechanism for supplying and releasing pressurized oil to and from the oil channel 18 of the rocker shaft 2, i.e., a mechanism (a variable valve control mechanism) for driving the pistons 14 of the cylinder parts 8.

An oil channel 42 in which pressurized oil supplied from an oil pump 41 (refer to FIG. 11) flows is formed at an end of the cylinder head 1, and an oil control valve (variable valve control mechanism) 43 for controlling the supply/release of pressurized oil to/from the oil channel 18 is provided in the oil channel 42. An accumulating channel 44 is branched from the oil channel 42 upstream of the oil control valve 43, and an accumulator 45 is connected to the accumulating channel 44. The accumulator 45 is fixed as a member to the cylinder head 1.

A second filter 46 is provided in part of the oil channel 42 upstream of the oil control valve 43 and upstream of part from which the accumulating channel 44 is branched. In FIG. 11, reference numeral 47 denotes a first filter provided on the discharge side of the oil pump 41, and reference numeral 48 denotes a bypass for bypassing the oil pump 41 and in which a relief valve, not shown, is disposed.

As shown in FIG. 10, the accumulator 45 has a cylindrical body 51 fixed in an upright direction to the cylinder head 1, and a piston 53, which is forced downward by a spring 52, is provided in the body 51 such that the piston 53 may slide in contact with the body 51. A spring sheet 54 and a snap ring 55 are provided at the upper part of the spring 52, which is housed in the body 51.

Thus, the single accumulator 45 is fixed as a single body to the cylinder head 1, and hence the accumulator 45 can be e.g., replaced and maintained easily, and the internal arrangement of the cylinder head 1 does not become complicated.

A screw part 56 is formed at a lower part of the body 51. By screwing the screw part 56 into a female screw part 57, the accumulator 45 is fixed to a hole 58 in the cylinder head 1. This improves the operability in attaching,and detaching the body 51. Therefore, the valve system for the internal combustion engine can be realized in which the accumulator 45 can be provided without deteriorating the ease of assembly.

When the accumulator 45 is fixed to the cylinder head 1, part of the upper part of the body 51 is protruded from the upper surface of the cylinder head 1. Fixing the body 51 to the cylinder head 1 brings the accumulating channel 44 into communication with the body 51, so that pressurized oil is supplied to an area below a piston 53. The piston 53 moves upward against the force of the spring 52 to cause pressurized oil to be accumulated in the body 51.

The upper part of the cylinder head 1 is provided with a cover 61, in which a baffle plate 62 and a flat plate 63 are provided for catching mist. The flat plate 63 is located just above the upper part of the body 51 protruded from the upper surface of the cylinder head 1. For this reason, if the snap ring 55 falls out, the spring sheet 54, spring 52, and piston 53 abut on the flat plate 63 to prevent pressurized oil from splashing to the outside.

A gap S1 formed between the upper part of the body 51 and the flat plate 53 is set to be shorter than a length S2 of the screw part 56. For this reason, if the body 51 fixed to the cylinder head 1 by screwing is loosened to move in a direction to fall off (upward), the upper part of the body 51 abuts the flat plate 63 before the screw 56 is disengaged, and hence the body 51 can be prevented from falling off from the cylinder head 1. Therefore, neither the oil channel 42 nor the accumulating channel 44 is opened to the outside.

Since the body 51 of the accumulator 45 is fixed to the cylinder head 1 by means of the screw part 56 at the lower part thereof, oil never leaks from the body 51 even when e.g., oil leakage occurs at part of the body 51 which is fixed to the cylinder head 1. Therefore, it is possible to suppress oil leakage to the outside even if the part of the body 51, which is fixed to the cylinder head 1, is sealed in a simple manner. The body 51 should not necessarily be fixed to the cylinder head 1 by means of the screw part 56, but for example, the body 51 may be fixed to the cylinder head 1 by press-fitting or by using a combination of a flange and a fastening screw.

In the above described mechanism for supplying/releasing pressurized oil to/from the oil channel 19 of the rocker shaft 2, when the oil pump 41 is driven to supply pressurized oil from the oil channel 42 to the accumulating channel 44, the pressurized oil is filtered by the second filter 44 and supplied to the oil control valve 43, accumulator 45, and exhaust side rocker shaft 3. When the oil control valve 43 is off (closed), the oil pressure of the accumulating channel 44 causes pressurized oil to be accumulated in the accumulator 45.

When the engine comes to revolve at a predetermined speed, the oil control valve 43 is turned on (opened) so as to selectively actuate the high-lift cam 20. The pressurized oil rapidly flows into the oil channel 18 of the intake side rocker shaft 2 via the oil control valve 43. On this occasion, the oil pressure of the oil channel 42 and the accumulating channel 44 is temporarily decreased due to a shortage of pressurized oil being supplied, and hence the pressurized oil accumulated in the accumulator 45 is pushed out by the force of the spring 52 to compensate for the shortage.

Therefore, pressurized oil can be supplied with a high responsiveness to the switching mechanism including the two cylinder parts 8 for each cylinder without causing shortage of pressurized oil.

According to the present invention, since the second filter 46 is disposed upstream of the accumulator 45, foreign matters included in the pressurized oil accumulated in the accumulator 45 can be removed. Therefore, it is possible to prevent foreign matters from entering the body 51 of the accumulator 45, and thus to prevent stick-slip of the piston 53.

Further, since the pressurized oil pushed out from the accumulator 45 is sent to the oil control valve 43 without passing through the second filter 46, pressurized oil can be supplied with a high responsiveness to the oil channel 18 of the rocker shaft 2 without being affected by pressure loss in pressurized oil flowing through the second filter 46.

Therefore, even in the valve system provided with the complicated connection switching mechanism including the first intake valve 9 and the second intake valve 11 which lift by different amounts, the pressurized oil accumulated by the second filter 46 to prevent foreign matters from becoming mixed in the accumulator 45. Therefore, the valve system for the internal combustion engine can be realized which can prevent foreign matters from becoming mixed in the accumulator 45.

In the above described embodiment, the internal combustion engine having the switching mechanism comprised of the first rocker arm 5, third rocker arm 6, and second rocker arm 7 is used as an internal combustion engine to which the above described configuration of the accumulator 45 is applied, and as an internal combustion engine to which the above described circuit configuration in which the oil control valve filter 46 is provided, but the present invention may be applied to an internal combustion engine provided with a switching mechanism having a different configuration. For example, the above described configuration of the accumulator 45 and/or the above described circuit configuration in which the oil control valve filter 46 is provided may be applied to an internal combustion engine of a one intake valve type which is configured to change two types of rocker arms which cause different valve lifts as stated in Japanese Laid-Open Patent Publication 2001-41017 filed by the applicant of the present invention.

Although in the above-described embodiment, the rocker shaft 2 on the intake side is provided with the cam switching mechanism, the present invention is not limited to this, but the present invention may be applied to an internal combustion engine in which the cam switching mechanism is provided on the exhaust side.

What is claimed is:

1. A valve system for an internal combustion engine, comprising:

a variable valve control mechanism for providing control to selectively open and close intake valves or exhaust valves according to supply/release of pressurized oil from an oil pressure source via an oil channel; and an accumulator provided upstream of said variable valve control mechanism, said accumulator having a body, a portion of which is inserted into and fixed in a hole formed in a cylinder head of the internal combustion engine, said accumulator being provided for accumulating pressurized oil supplied to said variable valve control mechanism.

2. A valve system for an internal combustion engine according to claim 1, wherein said body of said accumulator is cylindrical and vertically fixed to the cylinder head at a lower part of said body, said accumulator further including:

a piston adapted to slide in contact with an inner peripheral surface of said body, and a spring that urges said piston downward, wherein said accumulator is operable when accumulating pressurized oil, for pushing up said piston against a force of said spring by pressurized oil, and is operable when releasing pressurized oil, pushing down said piston by a force of said spring; and wherein an upper part of said body is disposed in vicinity of an inner wall of a head cover for the cylinder head.

3. A valve system for an internal combustion engine according to claim 2, wherein a length of a gap formed between the upper part of said body and the inner wall of the head cover is shorter than a length of the lower part of said body vertically fixed to the cylinder head.

4. A valve system for an internal combustion engine according to claim 2 or 3, wherein the lower part of said body fixed to the cylinder head includes a screw part.

5. A valve system for an internal combustion engine according to claim 1, further comprising:

a filter disposed upstream of said accumulator.

6. A valve system for an internal combustion engine according to claim 1, wherein said variable valve control mechanism selectively switches between a low-speed cam and a high-speed cam for opening/closing an intake valve or an exhaust valve.

7. A valve system for an internal combustion engine according to claim 1, wherein said portion of said body is screwed into said hole.

8. A valve system for an internal combustion engine according to claim 1, wherein said portion of said body is fixed in said hole to bring said body into communication with an upstream oil channel via an accumulation channel.

9. A valve system for an internal combustion engine according to claim 8, wherein said accumulation channel and said upstream oil channel collectively supply pressurized oil to said variable valve control mechanism.

* * * * *